United States Patent [19]

Wagoner et al.

[11] 4,423,776

[45] Jan. 3, 1984

[54] DRILLING HEAD ASSEMBLY

[76] Inventors: E. DeWayne Wagoner, 4302 St. Thomas, Oklahoma City, Okla. 73120; Earl D. Owen, 13854 E. Linvale, Aurora, Colo. 80014

[21] Appl. No.: 277,137

[22] Filed: Jun. 25, 1981

[51] Int. Cl.[3] ..... E21B 33/03

[52] U.S. Cl. ..... 166/84; 175/195; 277/31

[58] Field of Search ..... 166/84, 315; 175/209, 175/210, 195; 277/31

[56] References Cited

U.S. PATENT DOCUMENTS

| | | | |
|---|---|---|---|
| 4,208,056 | 6/1980 | Biffle | 277/31 |
| 4,281,724 | 8/1981 | Garrett | 166/84 X |
| 4,293,047 | 10/1981 | Young | 277/31 X |
| 4,304,310 | 12/1981 | Garrett | 277/31 X |
| 4,312,404 | 1/1982 | Morrow | 277/31 X |

*Primary Examiner*—Ernest R. Purser
*Assistant Examiner*—Michael Starinsky
*Attorney, Agent, or Firm*—Bill D. McCarthy

[57] ABSTRACT

An improved rotary drilling head assembly comprising a main housing having an axial bore therethrough; a stripper assembly disposed within the housing axial bore; and a stripper support assembly rotatingly supporting the stripper assembly. The stripper support assembly is removably attachable to the main housing and comprises an inner skirt member which is configured to extend about and to be supported on an exterior support surface of the main housing; an outer bearing housing configured to extend about and to be bearingly interconnected to the inner skirt member; a stripper clamp assembly clamping the stripper assembly to the outer bearing housing; and a clamping assembly removably attaching the inner skirt member to the exterior support surface such that the entire stripper support assembly of the drilling head assembly is removable from the housing as a unitary assembly by disengaging the clamping assembly.

32 Claims, 6 Drawing Figures

DRILLING HEAD ASSEMBLY

BACKGROUND OF THE INVENTION

1. Field of the Invention

The present invention relates to the field of oil field drilling equipment, and more particularly but not by way of limitation, to an improved rotary drilling head assembly.

2. Prior Art

In oil field drilling operations, a drilling head assembly is a piece of equipment which permits drilling mud to be circulated down the tool string, up the annulus between the tool string and the casing, and out of the drilling head assembly at the upper end of the wellbore casing. While this assembly is sometimes referred to as a rotating blowout preventor, the latter designation is not entirely accurate; while a drilling head assembly does serve as a seal at the top of the annulus of the wellbore, it may not contain the extremely high pressures associated with some oil well blowouts. The drilling head assembly does serve to seal the wellbore casing about the tool string driving kelly under normal conditions such that circulating drilling mud is exhausted below a stripper assembly and diverted to a receiving pit or tank. The sealing portion of the drilling head assembly rotates with the kelly and permits the selective insertion or retrieval of the tool string therethrough, while a stationary portion of the drilling head assembly is detachably connected to the wellbore casing.

Drilling head assemblies are well-known in the art and have assumed various configurations over the years. Examples of various types of such drilling head assemblies and so-called blowout preventors are presented in U.S. Pat. No. 3,400,938 issued to Williams in 1968; U.S. Pat. No. 3,868,832 issued to Biffle in 1975; U.S. Pat. No. 3,724,862 issued to Biffle in 1973; U.S. Pat. No. 3,965,987 issued to Biffle in 1976; U.S. Pat. No. 3,128,614 issued to Auer in 1964; U.S. Pat. No. 2,170,916 issued to Schweitzer, et al. in 1939; U.S. Pat. No. 3,023,012 issued to Wilde in 1962; U.S. Pat. No. 3,052,300 issued to Hampton in 1962; U.S. Pat. No. 2,176,355 issued to Otis in 1939; and U.S. Pat. No. 2,846,247 issued to Davis in 1958. All these patents show in some form a rotating kelly seal on a supporting member attachable to a wellbore casing.

The prior art drilling head assembly designs generally emphasized fluid security while featuring various operating or maintenance parameters. For example, one prior art blowout preventor is Biffle U.S. Pat. No. 4,154,448 issued in 1979. This patent teaches a structure which permits field disassembly of the blowout preventor to replace the bearings without having to remove the massive blowout preventor and transport it to a service shop. However, the experience of the present inventors has been that field replacement of bearing assemblies is difficult to achieve satisfactorily due to the location of the sealing apparatus and the environmental disturbances encountered.

SUMMARY OF INVENTION

The present invention provides an improved drilling head assembly which has a rotary stripper rubber assembly supported by a stripper support assembly which can be quickly removed from attachment to a main housing which itself is attached to the upper end of the wellbore casing. Once removed, the stripper support assembly is easily replaceable at the field location, and the stripper support assembly can be quickly reattached to the stationary main housing and placed back into service. The removed stripper support assembly can then be transported to a service center for bearing replacement.

Additionally, the present invention provides an improved lubrication system for maintaining a constantly fresh lubricant environment for the bearings contained in the stripper support assembly.

It is an object of the present invention to provide an improved rotary drilling head assembly which can be rapidly repaired and returned to service.

Another object of the present invention is to provide a drilling head assembly having external bearings completely isolated and protected from access by drilling fluids.

A further object of the present invention is to provide a drilling head assembly having bearings which are constantly subjected to a fresh and adequate supply of lubrication.

Yet another object of the present invention is to provide a drilling head assembly which is efficient to operate, which is readily maintained, and which is relatively inexpensive to manufacture.

Other objects, advantages and features of the present invention will become apparent from the following detailed description when read in conjunction with the drawings and appended claims.

BRIEF DESCRIPTION OF THE DRAWINGS

FIG. 6 is an enlarged view in cross-section of a portion of the drilling head assembly of FIG. 1 showing the bearing assembly thereof, and also showing in schematic representation a lubricating system therefor.

DESCRIPTION

Figure 1:
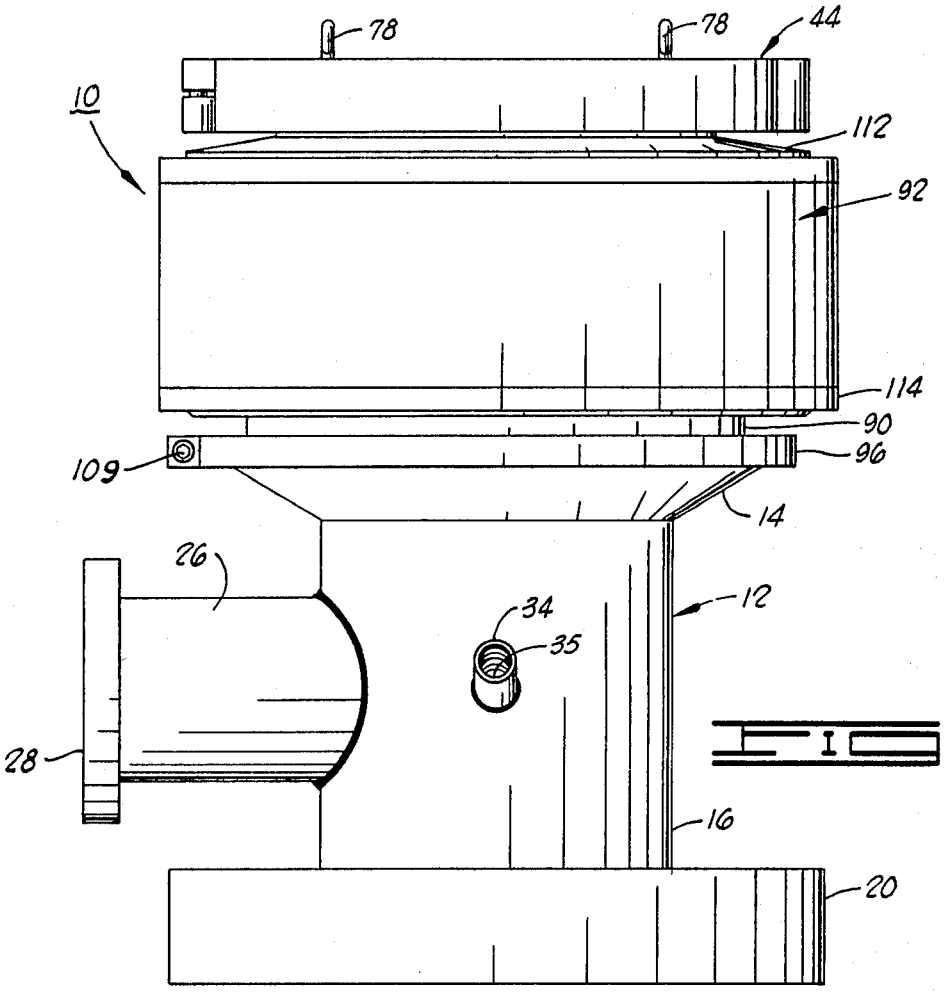
FIG. 1 is a side elevational view of a drilling head assembly constructed in accordance with the present invention.
Figure 2:
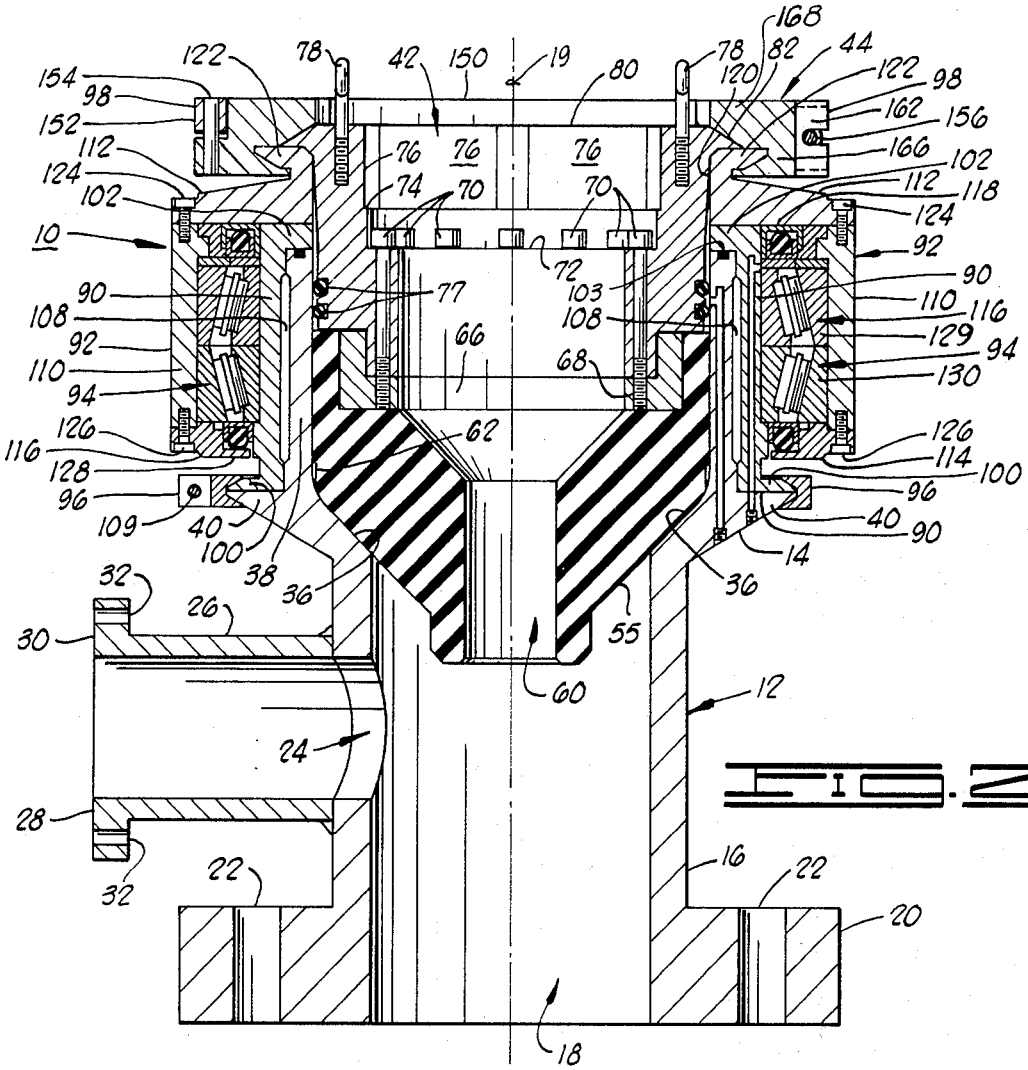
FIG. 2 is a longitudinal cross-sectional view of the drilling head assembly of FIG. 1.

Referring to the drawing in general and more specifically to FIGS. 1 and 2, shown therein is a rotary drilling head assembly 10 constructed in accordance with the present invention. The drilling head assembly 10 includes a stationary housing 12, sometimes hereinafter referred to as the main housing, having an upper end 14 and a lower end 16. An axial bore 18 extends through the housing 12 from the upper end 14 to the lower end 16; that is, the axial bore 18, substantially symmetrical about its longitudinal axis 19, extends completely through the housing 12. The lower end 16 has a flange 20 having a bolt circle 22 which is configured to mate with a similarly configured flange attached to the uppermost end of a wellbore casing (not shown) and attached thereto via appropriately sized bolts (also not shown).

The main housing 12 is provided with an exiting fluid port 24, and a communicating outlet conduit 26 is weldingly attached to the outer wall of the housing 12. The outlet conduit 26 has a flange 28 at its distal end 30 which is configured to mate with a similarly configured flange at the end of a mud transporting conduit (not shown), and appropriately sized bolts (not shown) extending through a bolt circle 32 and the flange 28 may be used to secure it to the mud transporting conduit. An auxiliary conduit 34 is weldingly connected to the outer wall of the housing 12 and a port 35 is provided through the outer wall to provide communication with the axial bore 18. This auxiliary conduit 34 is provided for purposes such as withdrawing testing samples, and if unneeded, it can be plugged.

The upper end 14 of the housing 12 is flared to form an inner seat 36, an upwardly extending support cylinder portion 38, and a radially extending support shoulder 40.

The drilling head assembly 10 also comprises a stripper assembly 42, sometimes referred to herein as a stripper rubber assembly, and a stripper support assembly 44. While each of these assemblies will be described more fully below, it will be noted that the stripper assembly 42 is disposable within the axial bore 18 of the main housing 12 and forms a fluid seal about a driving kelly member (not shown) and the inner seat 36 of the main housing 12. The stripper support assembly 44 is supported on the support cylinder portion 38 of the housing 12 while rotatingly supporting the stripper assembly 42 to permit the stripper assembly 42 to rotate in response to rotation of a driving kelly member extending through the axial bore 18.

Figure 4:
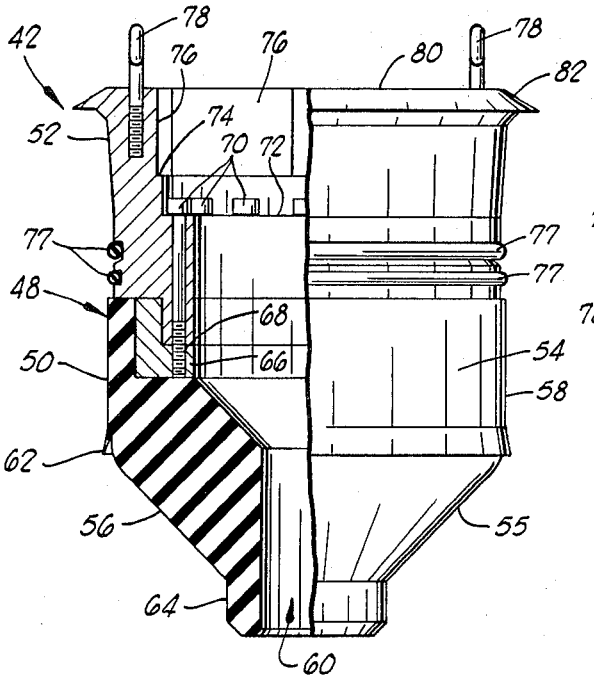
FIG. 4 is a side elevational view in partial cutaway detail of the stripper assembly of the drilling head assembly of FIG. 1.
Figure 5:
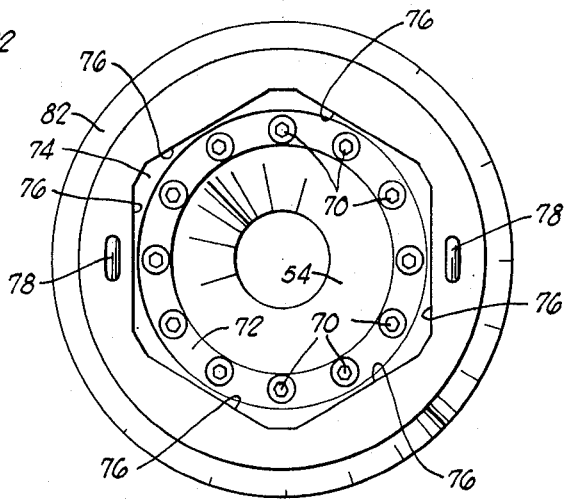
FIG. 5 is a top plan view of the stripper assembly of the drilling head assembly of FIG. 1.
Figure 5:
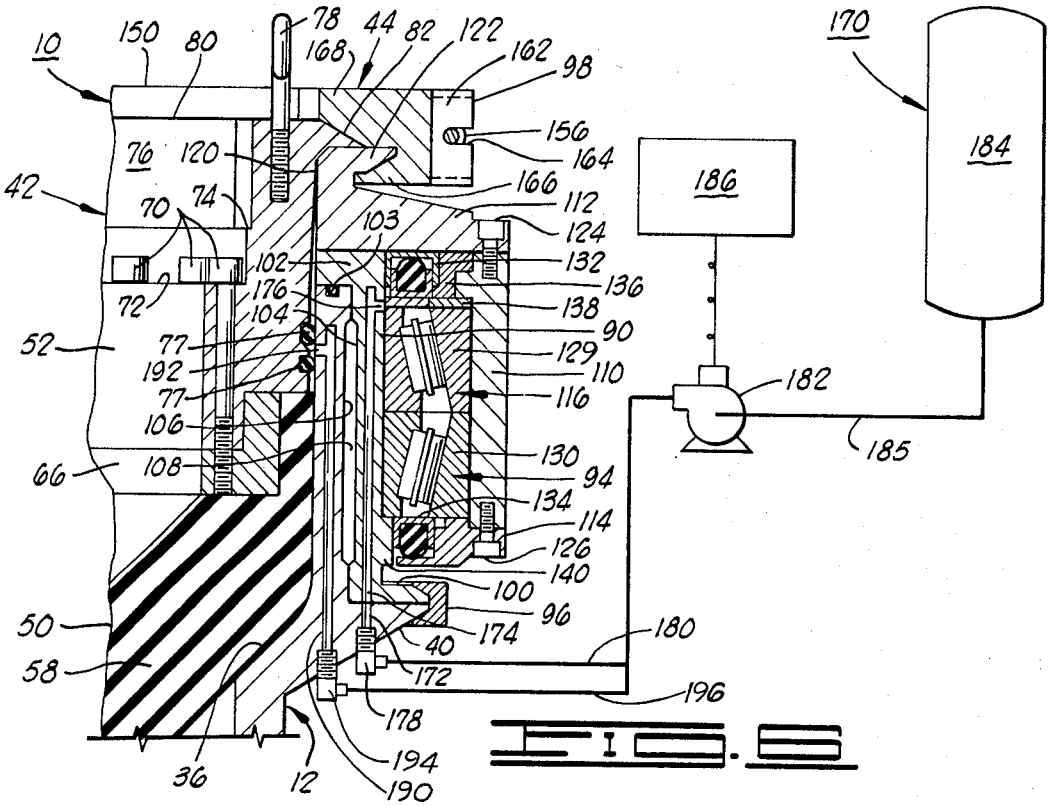

The stripper rubber assembly 42 most fully depicted in FIGS. 2, 4 and 5, has a stripper body 48 which has a lower stripper member 50 and an upper kelly gear engaging member 52 boltingly connected thereto. The stripper member 50 is of composite construction featuring an elastomeric member 54 which is shaped to form a conforming sealing surface 56 configured to sealingly engage the inner seat 36 of the housing 12. The sealing surface 56 also comprises the outer surface of the elastomeric member 54 near its upper portion 58 which is sized to be received in snug, rotating fit within the housing 12 on the inner seat 36 of the upper portion of the housing 12 in the manner depicted in FIG. 2. A protruding lip or debris barrier 62 extends outwardly and downwardly from the lower stripper member 50 and serves to seat against the inner wall of the housing 12 to prevent leak-by of drilling fluid since the seating of the lower stripper member 50 and the upper portion 58 against the inner seat 36 of the housing 12 is a somewhat loose fitting, rotating fluid seal.

An axial bore 60 is disposed through the stripper member 50 and is coaxially aligned with the axial bore 18 when the stripper member 50 is disposed therein. A lip portion 64 provided at the lower end of the stripper member 50 serves as a flexible seal about a kelly driving member (not shown) extended through the axial bore 60. The stripper member 50 is usually a molded rubber material which is selectively stiff but sufficiently flexible such that a kelly drive member attached to the upper end of a tool string is slidably passable through the axial bore 60; the lip portion 64, being substantially thinner than the body of the stripper member 50, is yieldingly moved by the kelly drive member to conform to the cross-section of the kelly drive member and sealingly engage against it.

Molded into the elastomeric lower stripper member 50 is an attaching ring member 66 (the ring member 66 may have appropriately spaced stiffeners, not shown, which extend into the elastomeric portion of the stripper member 50). The ring member 66 has a plurality of threaded apertures 68 spaced thereabout to threadingly receive bolts 70 which attach the gear engaging member 52 to the lower stripper member 50.

The gear engaging member 52 is preferably a body of sturdy metal construction designed for attachment to the lower stripper member 50 while being clearingly received within the axial bore 18 of the housing 12 as shown in FIG. 2. The bore 60 extends through the gear engaging member 52, and a recessed shoulder portion 72 is provided with a number of bolt receiving bores equal in number and equally spaced to match the threaded apertures 68, the bolts 70 extending therethrough to securely interconnect the gear engaging member 52 to the lower stripper member 50. The gear engaging member 52 has another shoulder portion 74 having planar walls 76 which are arranged symetrically about the axial bore 60. This arrangement provides for the acceptance within the gear engaging member 52 on the shoulder portion 74 and between the walls 76 of a kelly engaging donut gear (not shown) conventionally known. That is, the donut gear is a member which has planar external sides in the shape of a polygon, usually a hexagon, and which has a bore therethrough having planar walls forming a square or hexagonal cross-section. Most kelly drive members have either a square or hexagonal cross-section, and the donut gear member is designed to slidingly fit about the kelly drive member and to serve as a gear attachment thereto to rotate the stripper assembly 46 when assembled as a component part of the drilling head assembly 10.

The outer surface of the gear engaging member 52 is provided with a pair of peripherally extending grooves in which are disposed O-ring members 77 which are dimensioned to slidingly seal against the inner wall of the support cylinder portion 38 of the main housing 12. The O-ring members 77 complete the fluid seal, and together with the sealing provided by the debris barrier 62, the sealing surface 56 and the inner seat 36, serves to provide fluid sealing integrity under normal operating conditions and prevents upward passage of drilling fluid.

The gear engaging member 52 is also provided with a pair of hook members 78 which are threadingly connected thereto via a pair of thread apertures in the top surface 80 for the purpose of attaching a lifting chain or the like when setting or removing the stripper assembly 46 in or from the housing 12. The top surface 80 has a peripherally extending rim 82 which is configured to overlap the top of a seal ring of the stripper support assembly, which will be described next.

Turning to the stripper support assembly 44, it will be noted by reference to FIGS. 1 and 2 that this support assembly comprises an inner skirt member 90, an outer bearing housing 92, a bearing assembly 94, a clamping assembly 96, and a clamping assembly 98. These components of the support assembly 44 serve to provide a means for rotatingly supporting the stripper assembly 42 and are arranged such that the support assembly 44 is removable from the housing 12 as a unitary assembly.

The inner skirt member 90 is generally a cylindrically shaped body having an inside bore therethrough and having an inner diameter dimensionally determined such that the inner skirt member 90 is fittingly received over the outer surface of the upwardly extending support cylinder portion 38 of the housing 12. The inner skirt member 90 has a protruding shoe portion 100 extending from its lower end which is shaped to rest upon the support shoulder 40 of the housing 12, and an inwardly extending lip portion 102 which is shaped to hang over the uppermost end portion of the upper end 14 of the housing 12 as shown in FIG. 2. An O-ring 103 is disposed in a groove in the top of the uppermost end portion of the upper end 14 to prevent fluid leakage at this juncture. Aligned recessed surfaces 104 and 106 in the inner skirt member 90 and the housing 12, respectfully, provide an insulating air cavity 108 encircling the housing 12 beneath the inner skirt member 90, the cavity 108 designed to resist heat transfer from the bearing assembly 94 to the main housing 12.

The clamping assembly 96 is a generally donut-shaped member which comprises two half members pivotally interconnected at one set of ends and boltingly interconnectable at the other ends via bolt 109. The clamping assembly 96 is of conventional design so that further detail need not be provided; it is sufficient for the purpose of this disclosure to state that the clamping assembly 96 is a selected one of many available clamping mechanisms which can serve to removably clamp the inner skirt member 90 to the main housing 12 via the protruding shoe portion 100 and support shoulder 40. Preferably the profile of the clamping assembly 96 will overlap the outline of the protruding shoe portion 100 and support shoulder 40 in the manner depicted in FIGS. 2 and 6.

The stripper support assembly 44 further comprises the outer bearing housing 92 which includes a generally cylindrically shaped body member 110 having a top seal ring 112 and a bottom seal ring 114, the outer bearing housing 92 defining a bearing chamber 116 between it and the inner skirt member 90. The top seal ring 112 has a lower edge 118 which overlaps the inwardly extending lip portion 102 of the inner skirt member 90, and an inner surface 120 which is disposed in close clearing spatial relationship to the outer surface of the kelly gear engaging member 52 when disposed in the axial bore 18 of the main housing 12. The top portion of the seal ring 112 is undercut to form a clamp engaging ear 122. The seal ring 112 is bolted to the body member 110 via a plurality of bolts 124 which are threadingly engaged with appropriately spaced apertures in the body member 110.

The bottom seal ring 114 serves as a bearing retainer, and together with the top seal ring 112, serves to isolate the bearing chamber 116 to protect it from exposure to migrant pollutants such as drilling mud or dust. The bottom seal ring 114 is bolted to the body member 110 via a plurality of bolts 126 which are threadingly engaged with appropriately spaced apertures in the body member 110. The bearing chamber 116 has an inwardly extending seal retaining ring portion 128.

Disposed in the bearing chamber 116 is the bearing assembly 94 which includes a top bearing 129, a lower bearing 130, a top seal ring 132, a bottom seal ring 134, a spacer member 136, and a spacer member 138, as best shown in FIG. 6. The top bearing and bottom bearing 128, 130 are conventional roller thrust bearing ring and race sets which are pressed onto the external surface of the inner skirt member 90, and a bearing stop 140 may be provided on the inner skirt member 90 for locating and retaining the bearings which are stacked top on bottom as shown. The bearings 129, 130, once in position on the inner skirt member 90, are ready to receive the pressing thereon of the body member 110, less the bottom seal ring 114, so that the bearing assembly 94 serves to bearingly interconnect the body member 110 (and thus the stripper support assembly 44) to the stationary inner skirt member 90.

The tilt of the roller bearings 129, 130 can be oppositely pitched in order to optimize thrust and load bearing capability. The seal rings 132, 134 are also conventional seal rings appropriately sized for the dimensions of the drilling head assembly 10, and the spacer members 136 and 138 are appropriately shaped and sized to fill the remaining spaces of the bearing chamber 116, although it is recognized that the component makeup of the bearing assembly 94 will vary somewhat with the service requirements of the drilling head assembly 10.

Figure 3:
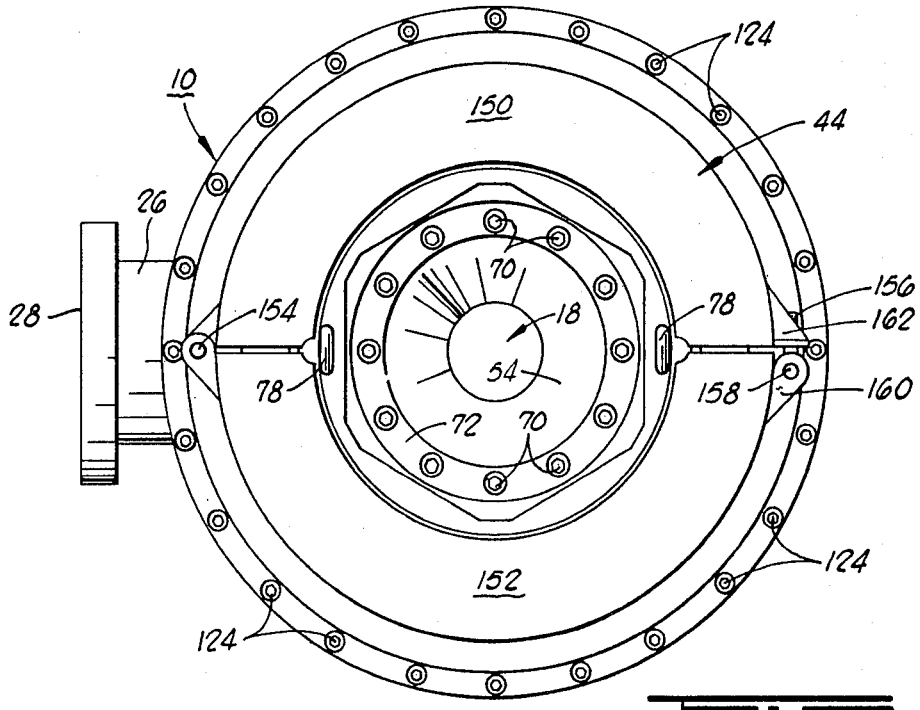
FIG. 3 is top plan view of the drilling head assembly of FIG. 1.

As best shown in FIGS. 2, 3 and 6, the stripper support assembly 44 also comprises the clamping assembly 98 which, as shown in FIG. 3, includes a first half member 150 and a second half member 152 pivotally interconnected at one end of each via a staked in position pin 154. At the other end of the second half member 152 is a bolt 156 pivotally connected thereto via a pin 158 extensive through appropriately positioned apertures in a pair of ear members 160 protruding from this end of the second half member 152. An ear member 162 extends from the corresponding end of the first half member 150, the ear member 162 having a slot 164 for receiving the body of the bolt 156. A nut on the bolt 156 is tightened against the ear member 162 to secure the clamping assembly 98. The profile of the clamping assembly 98 is shaped to provide a clamping ear 166 which locks over the clamp engaging ear 122 of the top seal ring 112, and to provide a rim portion 168 which overrides the top of the stripper assembly 42 to prevent removal thereof from the axial bore 18 of the main housing 12 and to lock the stripper assembly 42 to the stripper support assembly 44 when the clamping assembly 98 is clamped in place in the manner depicted in the drawings. Upon removal of the clamping assembly 98 via loosening of the nut on the bolt 156 and pivoting the two halves 150, 152 outwardly on the pivot pin 154, the stripper assembly 42 can be removed from the main housing 12 via chains hooked to the hook members 78.

Returning to the bearing assembly 94, the present invention provides a means of maintaining constant fresh lubricant to the bearings 129, 130 via a lubrication system 170 depicted schematically in FIG. 6. A first bore 172 is provided in the housing 12 and is caused to align with a second bore 174 extending upwardly in the inner skirt member 90, and a lubricating channel 176 provides fluid communication to the bearing chamber 116. A coupling member 178 is threadingly received and appropriately located in a threaded aperture in the main housing 12, and a first lubricating conduit 180 is connected thereto and to a lubricating pump 182. The pump 182 is connected to a source of lubricant 184 via a conduit 185. The pump 182 is energized in a controlled manner by a control system 186. Details of the control system 186 are conventional and need not be described further herein; it is sufficient to state that the control system 186 can be a timer circuit for energizing the pump to flow pressurized lubricant to the bearing assembly 94 on a selected time cycle, or a conventional pressure regulator system can be used so as to pump liquid lubricant to the bearing chamber 116 whenever the lubricant pressure drops below a selected pressure head, with the timer circuit believed to be preferable.

The lubrication system 170 also provides lubrication to the inner seat 36 of the main housing 12 and to the O-ring members 77 via a bore 190 extending upwardly in the main housing 12, and a lubricating channel 192 provides fluid communication to the axial bore 18 near the O-ring members 77. While one such lubricating channel 192 is depicted in the drawings, it will be appreciated that multiple channels may be provided. A coupling member 194 is threadingly received in an appropriately located and threaded aperture in the housing 12, and a second lubricating conduit 196 is connected thereto into the first conduit 180 such that lubricant is pumped to the second lubricating conduit 196 by the pump 182. This arrangement provides constant lubrication to the O-ring members 77 and to the inner seat 36 as the bearing assembly 94 is lubricated.

It will be clear that the present invention is capable of achieving the hereinabove stated objects. In the assembled form, the drilling head assembly 10 provides a seal between a rotating drilling kelly and the upper wellhead casing such that drilling fluid injected through the hollow kelly and rising from the wellbore will be diverted so as to exit the outlet conduit 26. As the kelly and its attached tool string are inserted through the axial bores 18 and 60 respectively of the main housing 12 and the stripper rubber assembly 42, the elastomeric member 54 yieldingly seals about the kelly and the tool string via the lip portion 64 thereof. Once the tool string is completed, the kelly is disposed such that a kelly engaging donut gear disposed over the kelly is seated within the kelly gear engaging member 52. As the kelly is drivingly rotated, the stripper rubber assembly 42 is rotated therewith, along with the stripper support assembly 44 with the exception that the inner skirt member 90 is grippingly retained against the main housing 12 via the clamping assembly 96.

Should it become necessary to repair the bearings of the drilling head assembly 10, it will be recognized that the present invention permits the ready replacement of the stripper support assembly 44 once the kelly has been removed from the stripper assembly 42. To achieve this removal, the clamping assembly 98 is removable by loosening the bolt 156 and swinging the two half members 150, 152 outwardly on the pivot pin 154 and setting the clamping assembly 98 aside. This permits the removal of the stripper assembly 42 via any conventional means such as by chains hooked to the hook members 78. Once the stripper assembly 42 is removed, it is a simple matter to disconnect the stripper support assembly 44 from the main housing 12 by loosening the bolt 109 and removing the clamping assembly 96. The stripper support assembly 44 can then be lifted free of the housing 12. A replacement stripper support assembly 44 can then be placed onto the housing 12 and the drilling head assembly 10 reassembled in the reverse order described above.

This relatively quick replacement of the stripper support assembly 44 permits the drilling head assembly 10 to be kept in service while the removed stripper support assembly 44 is transported to a service center for correction of the bearing problem. This capability permits a standby stripper support assembly 44 to be maintained, minimizing down time, while providing an efficient and effective drilling head assembly for the reasons and in the manner described hereinabove.

It is clear that the present invention is well adapted to carry out the objects and to attain the ends and advantages mentioned as well as those inherent therein. While the presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. An improved drilling head assembly for a wellbore, comprising:

a stationary housing having an upper end and a lower end, an axial bore extending through the housing from the upper end to the lower end and configured to receive the extension therethrough of a rotatable driving member, the housing having an inner sealing surface;

stripper means disposable within the axial bore for forming a fluid passage seal between the driving member extended through the axial bore and the inner sealing surface of the housing; and stripper support means removably supported at the upper end of the housing for supporting the stripper means so that the stripper means is rotatable with the driving member while sealingly engaging the inner sealing surface of the housing, the stripper support means comprises a head assembly characterized as comprising:

an inner skirt member configured to be disposed about the exterior of the housing;

clamping means for removably securing the inner skirt member to the housing;

an outer bearing housing assembly extending about the inner skirt member;

bearing means for attaching the bearing housing to the inner skirt member so that the outer bearing housing rotates about the inner skirt member; and stripper clamp means for securing the stripper means to the outer bearing housing so that the stripper means and the outer bearing housing are rotatably responsive to the driving member when extended through the axial bore.

2. The drilling head assembly of claim 1 wherein the outer bearing housing and the inner skirt member are configured to form a bearing chamber therebetween, and wherein the bearing means comprises:

at least one bearing assembly disposed within the bearing chamber and bearingly connecting the inner skirt member and the outer bearing housing; and bearing chamber seal means for sealing the ends of the bearing chamber.

3. The drilling head assembly of claim 2 further comprising:

lubrication means for providing a lubricant to the bearing assembly.

4. The drilling head assembly of claim 2 wherein the stripper means comprises:

a stripper rubber assembly having a stripper rubber portion having a stripper axial bore extensive therethrough and configured to receive the driving member therethrough, the stripper member being sufficiently elastic so that the stripper member sealingly engages the external surfaces of the driving member.

5. The drilling head assembly of claim 4 wherein the stripper rubber portion has peripherally extending debris barrier which sealingly engages the inner sealing surface of the housing.

6. The drilling head assembly of claim 5 wherein the inner sealing surface of the housing is configured to form a beveled seating area and the stripper rubber portion has a portion which is externally configured to have a beveled seating surface which substantially conforms to the beveled seating area so that the stripper rubber portion is rotatably seated against the beveled seating area.

7. The drilling head assembly of claim 6 wherein the stripper means has at least one O-ring member peripherally extensive such that the O-ring member slidingly and sealingly engages a portion of the inner sealing surface of the housing.

8. The drilling head assembly of claim 7 wherein the stripper rubber assembly further comprises:

a donut attachment ring secured to the stripper rubber portion;

a donut member configured for attachment to the donut attachment ring, the stripper axial bore extensive through the donut attachment ring and the donut member, the donut member configured to seatingly receive a driving gear member configured to slidingly fit about the driving member so that rotational energy imparted to the driving gear member is imparted to the donut member; and bolt means for attaching the donut member to the donut attachment ring.

9. The drilling head assembly of claim 8 wherein the stripper rubber assembly further comprises a donut seal means disposed about the donut member for sealingly communicating with the inner sealing surface of the housing.

10. The drilling head assembly of claim 8 further comprising:

lubrication means for providing lubrication to the inner sealing surface of the housing.

11. The drilling head assembly of claim 8 further comprising:

lubrication means for providing lubrication to the bearing assembly.

12. The drilling head assembly of claim 8 further comprising:

lubrication means for providing continuous lubrication to the inner sealing surface of the housing and to the bearing assembly.

13. The drilling head assembly of claim 12 wherein the lubrication means comprises:

pump means connectable to a lubricant source for selectively pressurizing the lubricant when actuated;

conduit means for transporting the pressurized lubricant to the inner sealing surface of the housing and to the bearing assembly; and lubricant control means for selectively actuating the pump means so that lubricant is flowed to the inner sealing surface and the bearing assembly through the conduit means.

14. The drilling head assembly of claim 1, 2, 3, 4, 5, 6, 7, 8, 9, 10, 11, 12 or 13 wherein the inner skirt member and the exterior of the housing form a thermal chamber therebetween whereby transfer of heat energy generated by the friction of the bearing assembly is at least partially impeded.

15. The drilling head assembly of claim 14 wherein the housing is provided with an outlet conduit which communicates with the axial bore of the housing between the stripper means and the lower end of the housing.

16. The drilling head assembly of claim 15 wherein the housing is provided with at least one auxiliary outlet conduit which communicates with the axial bore of the housing between the stripper means and the lower end of the housing.

17. A drilling head assembly comprising:

a main housing having an axial bore through which a driving member can be extended into a wellbore, the axial bore extending from an upper end to a lower end of the housing, the housing having at least one housing outlet opening disposed generally near the lower end thereof in fluid communication with the axial bore, the housing having an exterior support surface disposed at the upper end thereof;

stripper means disposable within the housing in the axial bore thereof for forming a fluid seal about the driving member and between the housing outlet and the housing upper end; and stripper support means for rotatingly supporting the stripper means, the stripper means comprising:

an inner skirt member configured to extend about and supported on the housing exterior support surface;

clamping means for removably attaching the inner skirt member to the housing in a stationary position;

an outer bearing housing configured to extend about the inner skirt member to form a bearing chamber therebetween;

bearing means for rotatingly connecting the outer bearing housing to the inner skirt member so that the outer bearing housing rotates about the inner skirt member and so that the inner skirt member, the outer outer bearing housing and the bearing means are removable from the housing as a unitary assembly by disengaging the clamping means; and stripper clamp means for removably securing the stripper means to the outer bearing housing so that the stripper means and the outer bearing housing are connected for rotation in response to rotation of the driving member extended through the axial bore.

18. The drilling head assembly of claim 17 wherein the bearing means comprises:

at least one bearing assembly disposed within the bearing chamber and bearingly connecting the inner skirt member and the outer bearing housing;

bearing chamber seal means for sealing the bearing chamber so that the bearing chamber is substantially sealed such that the bearing assembly is protected from exposure to foreign matter.

19. The drilling head assembly of claim 18 further comprising:

lubrication means for lubricating the bearing assembly.

20. The drilling head assembly of claim 18 wherein the stripper means comprises:

a stripper rubber assembly having a stripper rubber portion having a stripper axial bore extensive therethrough and configured to receive the driving member therethrough, the stripper member being sufficiently elastic and the diameter of the stripper axial bore dimensioned so that the wall of the stripper axial bore is caused to sealingly press against the external surfaces of the driving member as the driving member is extended through the stripper axial bore and through the housing axial bore.

21. The drilling head assembly of claim 20 wherein the wall of the housing along a portion of the housing axial bore forms an inner sealing surface, and wherein the stripper rubber portion of the stripper rubber assembly has a peripherally extending debris barrier which sealingly engages the inner sealing surface.

22. The drilling head assembly of claim 21 wherein a portion of the inner sealing surface is shaped as a beveled seating area, and wherein a portion of the stripper rubber portion of the stripper rubber assembly is externally configured to have a beveled seating surface substantially conforming to the beveled seating area of the inner sealing surface so that the stripper rubber portion is rotatably seated against the beveled seating area.

23. The drilling head assembly of claim 22 wherein the stripper means has at least one O-ring member peripherally extensive such that the O-ring member slidingly and sealingly engages a portion of the inner sealing surface of the housing.

24. The drilling head assembly of claim 23 wherein the stripper rubber assembly further comprises:

a donut attachment ring secured to the stripper rubber portion;

a donut member configured for attachment to the donut attachment ring, the stripper axial bore extensive through the donut attachment ring and the donut member, the donut member configured to seatingly receive a driving gear member configured to slidingly fit about the driving member so that rotational energy imparted to the driving gear member is imparted to the donut member; and bolt means for attaching the donut member to the donut attachment ring.

25. The drilling head assembly of claim 23 wherein the stripper rubber assembly further comprises a donut seal means disposed about the donut member for sealingly communicating with the inner sealing surface of the housing.

26. The drilling head assembly of claim 23 further comprising:

lubrication means for providing lubrication to the inner sealing surface of the housing.

27. The drilling head assembly of claim 23 further comprising:

lubrication means for providing lubrication to the bearing assembly.

28. The drilling head assembly of claim 23 further comprising:

lubrication means for continuously providing lubrication to the inner sealing surface of the housing and to the bearing assembly.

29. The drilling head assembly of claim 28 wherein the lubrication means comprises:

pump means connectable to a lubricant source for selectively pressurizing the lubricant when actuated;

conduit means for transporting pressurized lubricant to the inner sealing surface of the housing and to the bearing assembly; and lubricant control means for selectively actuating the pump means so that lubricant is flowed to the inner sealing surface and to the bearing assembly through the conduit means.

30. The drilling head assembly of claim 17, 18, 19, 20, 21, 22, 23, 24, 25, 26, 27, 28 or 29 wherein the inner skirt member and the exterior of the housing form a thermal chamber therebetween whereby transfer of heat energy generated by the friction of the bearing assembly is at least partially impeded.

31. The drilling head assembly of claim 30 wherein the housing is provided with an outlet conduit which communicates with the axial bore of the housing between the stripper means and the lower end of the housing.

32. The drilling head assembly of claim 31 wherein the housing is provided with at least one auxiliary outlet conduit which communicates with the axial bore of the housing between the stripper means and the lower end of the housing.

* * * * *